United States Patent [19]

Green et al.

[11] Patent Number: 5,042,842

[45] Date of Patent: Aug. 27, 1991

[54] HIGH SECURITY LABEL

[75] Inventors: Alan Green, Upland; Ronald J. Reiss, Alta Loma; Douglas W. Wilson, Covina, all of Calif.

[73] Assignee: Avery International Corporation, Pasadena, Calif.

[21] Appl. No.: 544,244

[22] Filed: Jun. 26, 1990

[51] Int. Cl.[5] ..... B42D 15/00

[52] U.S. Cl. ..... 283/101; 283/81; 283/92; 283/94; 428/202

[58] Field of Search ..... 283/92, 108, 81, 94, 283/95, 96, 101; 428/201, 202, 916

[56] References Cited

U.S. PATENT DOCUMENTS

| | | | |
|---|---|---|---|
| 2,129,364 | 9/1938 | Simons et al. | 283/101 |
| 2,223,106 | 11/1940 | Humphner | 283/101 |
| 2,262,492 | 11/1941 | Farrell | 283/92 |
| 3,533,176 | 10/1970 | Weitzberg et al. . | |
| 3,864,855 | 2/1975 | Pekko et al. . | |
| 3,919,447 | 11/1975 | Kilmer, Jr. et al. . | |
| 3,937,565 | 2/1976 | Alasia . | |
| 4,082,873 | 4/1978 | Williams | 428/202 |
| 4,092,654 | 5/1978 | Alasia . | |
| 4,109,047 | 8/1978 | Fredrickson . | |
| 4,121,003 | 10/1978 | Williams | 428/202 |
| 4,184,701 | 1/1980 | Franklin et al. . | |
| 4,198,147 | 4/1980 | Alasia . | |
| 4,227,719 | 10/1980 | McElligott et al. | 283/92 |
| 4,246,307 | 1/1981 | Trautweir | 283/109 |
| 4,273,816 | 6/1981 | Tollette | 428/202 |
| 4,307,899 | 12/1981 | Hoppe . | |
| 4,397,142 | 8/1983 | Bingham | 283/81 |
| 4,407,443 | 10/1983 | McCorkle | 283/95 |
| 4,500,116 | 2/1985 | Ferro et al. . | |
| 4,517,044 | 5/1985 | Arnold | 428/202 |
| 4,674,771 | 6/1987 | Thompson, II . | |
| 4,738,472 | 4/1988 | Shibata . | |
| 4,763,931 | 8/1988 | Matsuguchi et al. . | |
| 4,826,213 | 5/1989 | Matsuguchi et al. . | |
| 4,841,652 | 1/1989 | Sakashita et al. . | |
| 4,846,504 | 7/1989 | McGregor et al. | 283/81 |

FOREIGN PATENT DOCUMENTS

| | | | |
|---|---|---|---|
| 0081600 | 7/1976 | Japan | 283/108 |

*Primary Examiner*—Frank T. Yost
*Assistant Examiner*—Hwei-Siu Payer
*Attorney, Agent, or Firm*—Poms, Smith, Lande & Rose

[57] ABSTRACT

A high security label is disclosed which includes a multiple layer security label with a base layer with a permanent adhesive coated on its lower surface. Indicia or markings are applied to the bottom surface of the top layer. The top layer is laminated to the upper surface of the base layer by a permanent patterned adhesive. The patterned adhesive is formed so as to leave a portion of the upper surface of the base layer and the bottom surface of the top layer free from adhesive. The markings are applied to the bottom surface of the top layer in at least the adhesive free areas.

20 Claims, 2 Drawing Sheets

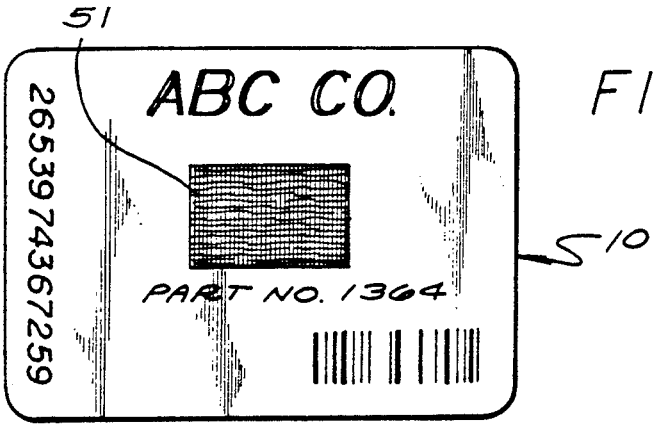
FIG. 3
FIG. 4
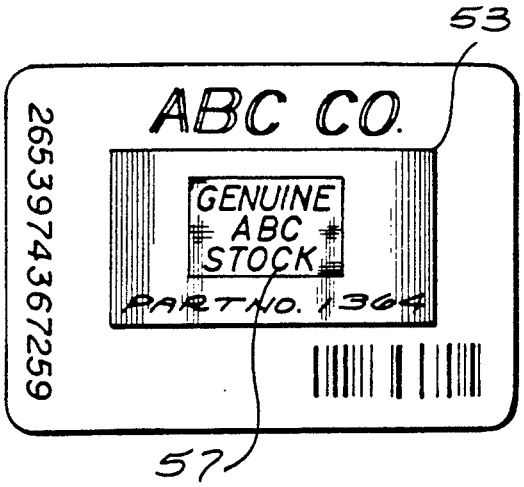
FIG. 5
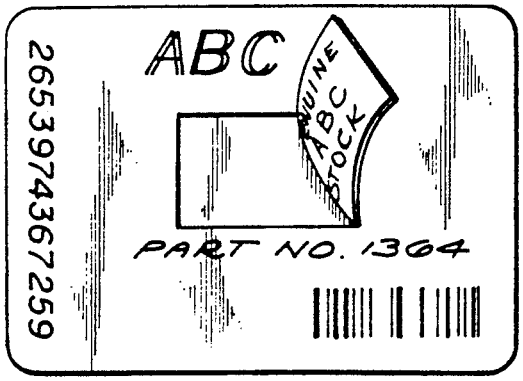
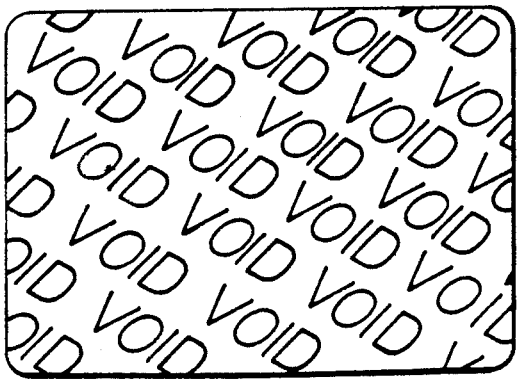
FIG. 6

HIGH SECURITY LABEL

FIELD OF THE INVENTION

This invention relates in general to labels and more particularly to labels for preventing or detecting tampering and counterfeiting.

BACKGROUND OF THE INVENTION

Counterfeiting of products, particularly replacement parts for machinery, is more rampant than ever. Verifying the authenticity of a replacement part, or other product, throughout the chain of distribution is therefore more important than ever. Simple printed labels can be easily counterfeited. Therefore, there is a need for sophisticated labels which will foil attempts at counterfeiting. Also, security labels should thwart attempts to tamper with the labels, or to switch them from one part to another.

SUMMARY OF THE INVENTION

In accordance with one aspect of the invention, a multiple layer security label includes a base layer with a permanent adhesive coated on its lower surface. Indicia or markings are applied to the bottom surface of a top layer. The top layer is laminated to the upper surface of the base layer by a patterned adhesive. The patterned adhesive is formed so as to leave a portion of the upper surface of the base layer and the bottom surface of the top layer free from adhesive. The markings are applied to the bottom surface of the top layer in at least the adhesive free areas.

The label is then ready to be applied, via the permanent adhesive layer, to a product. At any point in the distribution channel, including the end user, a razor blade or other sharp instrument can be used to cut a flap in the label which will permit the top layer to be peeled back and the indicia to be revealed. The presence of the markings indicates that the label is not a counterfeit. The indicia may be imprinted with invisible ink, ultra violet sensitive ink, or both. The printing on the upper face of the label may include an identification of the area which is free of the laminating adhesive and where the indicia is located.

Another aspect of the invention involves the use of an aggressive permanent base adhesive with a relatively weak base layer paper such that attempting to remove the label from the surface it is adhered to will cause the base layer to tear or separate before the adhesive will detach.

In accordance with a comprehensive illustrative example of the invention, the label may include all or selected ones of the following features in addition to the two features (1) and (2) mentioned above:

(3) A top layer including an area printed in a special way which is unreadable to the unaided eye, but legible using a special optical device.

(4) Placing a serial number on each label, with other security features such as the nature of the indicia mentioned in the first paragraph of this Summary of the Invention section, being changed with different series of serial numbers.

(5) Forming the base paper of a security paper such as is used by banks for checks so that soaking of the labels in organic solutions, or acidic or basic solutions will "VOID" the labels.

(6) Adding special "taggant" material or a dye to the permanent pressure sensitive material so the label bears a "footprint" where it has been adhered to a part.

The above described features, as well as other objects, features and advantages of the present invention will become apparent from a consideration of the following detailed description and the accompanying drawings.

BRIEF DESCRIPTION OF THE DRAWINGS

FIG. 3 shows the front of a single label;

FIG. 4 shows the label of FIG. 3 with a plastic optical decoding viewer placed over the center portion of the label;

FIG. 5 shows a single label with the center portion of the top layer folded back; and FIG. 6 shows the safety stock label after exposure to a solvent or a base solution.

DETAILED DESCRIPTION

Figure 2:
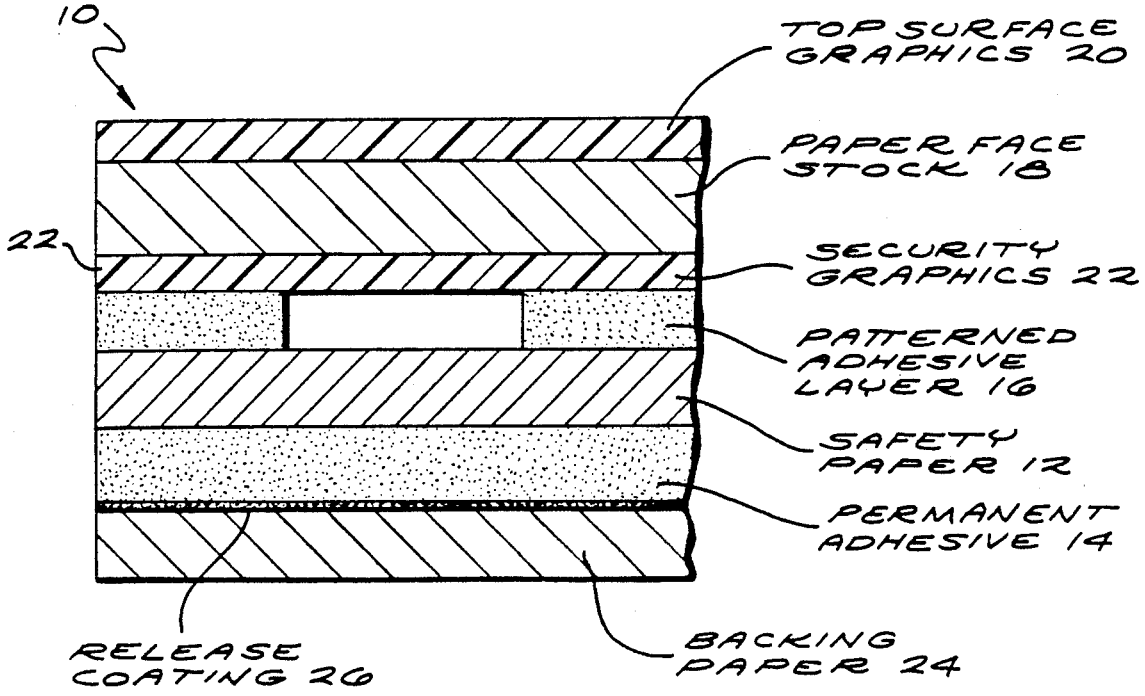
FIG. 2 is a cutaway or cross-sectional view of one of the security labels shown in FIG. 1 taken along line 2—2.

A preferred embodiment of the present invention is shown in FIG. 2. The security label 10 pictured in FIG. 2 includes safety paper (base layer) 12. A pressure sensitive permanent adhesive layer (base adhesive layer) 14 is deposited on the lower surface of the safety paper 12. The permanent adhesive 14 preferably has an adhering power such that attempting to remove the label from a surface to which the label has been adhered will cause the safety paper 12 to separate or tear before the permanent adhesive 14 will detach.

A patterned adhesive layer 16 is deposited on the upper surface of the safety paper 12. The patterned adhesive layer 16 is applied to safety paper 12 in a manner such that a portion of the upper surface of the safety paper 12 is left free from adhesive.

Paper face stock (top layer) 18 is laminated to the upper surface of the safety paper 12 by the patterned adhesive layer 16. Surface graphics 20 are applied to the top surface of the paper face stock. Security features (markings) 22 are applied to the bottom surface of the paper face stock, and may be confined to the adhesive-free area or areas.

The safety paper 12 image of the type commonly used in financial documents. It can be of 20 to 24 lb. paper which is uncoated bleached Kraft paper containing multiple security features. Those features would include having a weak tensile strength such that the safety paper 12 would tear or separate before the permanent adhesive 14 could be removed from a surface to which they had been affixed. This feature is intended to hamper attempts to remove the label and reaffix it to counterfeit goods.

Safety paper 12 may also contain fluorescent fibers. The fluorescent fibers fluoresce under certain conditions. This characteristic can be utilized for detecting counterfeit labels. The fluorescent fibers can be easily detected by passing a label under a "black" or ultraviolet light. The presence of the fibers would indicate that the label was genuine, or at least that it is formed of the special safety paper. Also the safety paper may contain a watermark, for example in the pattern of the Avery Company logo.

Further, in a preferred embodiment, the safety paper 12 would also be sensitive to organic solvents and basic solutions. When exposed to an organic solvent, the paper would turn blue or any other indicative color. When exposed to a basic or alkaline solution, the paper would turn brown or another indicative color. Alternatively, selected portions of the paper could turn either blue or brown and the selected portions could spell out words such as "void" or "tampered." Also possible are words such as a customer or company name. This feature is shown in FIG. 6.

FIG. 6 shows a label which has been exposed to an organic solvent or a basic solution with the safety paper being sensitive in selected areas which spell out the word "VOID" when exposed to a solvent or basic solution. The purpose of this feature is to prevent tampering with the label in the form of attempting to alter the surface graphics 20 by either eradicating the ink or bleaching. Safety paper with the features discussed above is commercially available from Boise Cascade Corporation, Georgia-Pacific Corporation and Mead Paper, Fine Paper Division. In a preferred embodiment, the paper is of a 20 lb. weight, 3.5 mils thick and includes all of the security features mentioned above.

The pressure sensitive permanent adhesive layer 14 adheres the label to the product or goods to which it is attached. The adhesive layer 14 is preferably a high performance, aggressive, permanent rubber based or acrylic adhesive. The choice of rubber based or acrylic adhesive depends upon the type of surface to which the label is to be applied. A layer of 0.5 to 1.5 mils is acceptable. In a preferred embodiment, the adhesive is a rubber-based type with a thickness of 1.0 mils.

In a preferred embodiment, the pattern adhesive layer 16 is applied to the paper face stock 18 in a pattern such that a selected interior area or areas of the label will remain non-laminated. Of course, the non-laminated portion of the label could be in various shapes and in various locations within the body of the label. The purpose of the non-laminated area is to allow a person who suspects the label may be a counterfeit to cut open the label and peel back the non-laminated area. This feature will be discussed more fully below.

Permanent acrylic or rubber based hot melt pressure-sensitive adhesives, hot-melt laminating adhesives, or water based laminating adhesives may be used for the patterned adhesive layer 16. In a preferred embodiment, a permanent rubber based hot melt pressure sensitive adhesive with a coating thickness of about 1.0 mils is used. Appropriate adhesives are available from H. B. Fuller Company, Findley Adhesives, Inc., and National Starch and Chemical Corp.

The paper face stock 18 is laminated to the upper surface of the safety paper 12 by the patterned adhesive layer 16. The paper face stock may be a 40 to 60 lb. bleached Kraft paper with a top coating to enhance printing via dot matrix, thermal transfer, laser or ink jet printing. The thickness of the paper should be within the range of 2 to 4 mils. Preferably, the paper is of a 41 lb. weight with a thickness of 2.2 mils. Appropriate paper can be obtained from DuPont Specialty Imaging Media, Inc., American Coating Technology, Inc., or James-River Corp.

The paper face stock 18 has security graphics 22 applied to its bottom surface (the surface facing towards the safety paper). The security graphics can include visible printing such as a manufacturer's logo or message. The safety graphics 22 could also contain words or symbols printed in fluorescent inks. The security graphics 22 would only be visible when a flap has been cut in the label corresponding to the non-laminated area of the label. The non-laminated area of the label is that portion of the label which does not contain any patterned adhesive. Thereby, if a purchaser or other person suspected that the label is a counterfeit, he could slice open three sides of a rectangle or a flap and peel back the non-laminated portion of the label to see if the security graphics are present as shown in FIG. 5. A lack of the security graphics would indicate a counterfeit label.

The surface graphics 20 are applied to the top surface of the paper face stock 18. Preferably, the graphics would contain some type of symbol or other markings indicating where the non-laminated section of the label is located so that a person wishing to verify the existence of the security graphics would know where to cut to peel back the non-laminated portion of the label to expose the security graphics.

In a preferred embodiment the surface graphics would include Scrambled Indicia TM. The scrambled indicia is fully described in U.S. Pat. Nos. 3,937,565, 4,092,654, and 4,198,147, assigned to Graphic Security Systems Corporation, which are incorporated herein by reference as though fully set forth herein.

The scrambled indicia 51 is shown on label 10 in FIG. 3. Placing a specially designed piece of optical plastic 53 over the scrambled indicia 51 unscrambles that portion of the label 57. In that manner, an inspector can quickly ascertain another factor indicating whether the label is genuine. The adhesive free area may be located directly under the scrambled indicia area 51, or preferably at another readily identified interior area.

The surface graphics may also contain words or images in fluorescent inks of the type described earlier. The upper and lower surfaces of the paper face stock might also be coated with a layer of fluorescent varnish. The surface graphics might further contain consecutive numbering or serial numbers. A preferred embodiment would incorporate all of the above features.

Also shown in FIG. 2 is release coated backing paper. The release coated backing paper is comprised of backing paper 24 and release coating 26. Release coating 26 is preferably a thin layer of silicone. The backing paper itself is preferably of 42 lb. weight 2.5 mil. thick super-calendered, bleached craft paper. The labels may be applied to the release coated backing paper for storage and transport. The permanent adhesive 14 easily detaches from the release coating 26 without causing any damage to the safety paper 12.

Figure 1:
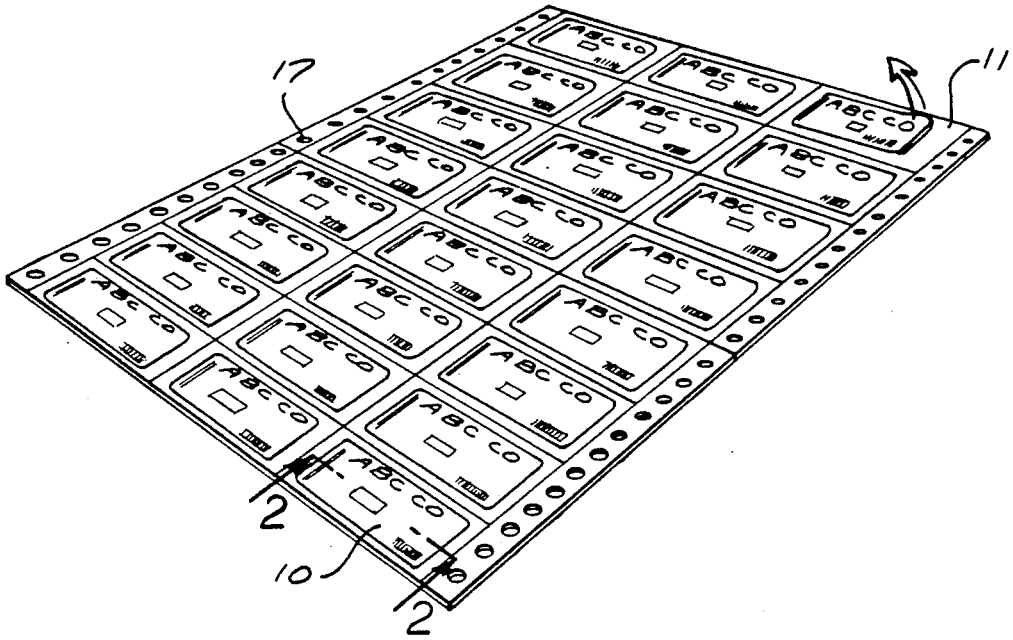
FIG. 1 shows an array of labels on a wide sheet of backing paper.

FIG. 1 shows an array of security labels such as pictured in FIG. 2 placed on a wide sheet of release coated paper 11. The release coated paper 11 has apertures 17 which can be used in automated label producing and label applying equipment.

It is to be understood that the disclosed label construction is merely illustrative of the principles of the present invention which could be implemented by other types of structure constructed of different materials. Thus, by way of example and not of limitation, the backing paper and the face stock could be formed of plastic sheet material, and other adhesives could be used. Accordingly, the scope of the present invention is not limited to the embodiments shown in the drawings and specifically described herein above.

What is claimed is:

1. A multiple layer security label comprising:

a base layer having upper and lower surfaces;

a base permanent adhesive layer on the lower surface of the base layer;

a top layer having a top surface and a bottom surface;

means for permanently securing together said top layer and said base layer to prevent them from being separated without destroying either or both of said layers, said means including a patterned permanent laminating adhesive layer securing said top layer to said base layer, the patterned laminating adhesive layer being formed so as to leave a portion of the upper surface of the base layer free from adhesives; and markings applied to the bottom surface of the top layer in at least the adhesive-free portion.

2. A security label as defined in claim 1, further including release coated backing paper, the base layer being releasably attached to the release coated backing paper by the base adhesive layer.

3. A security label as defined in claim 1, wherein the markings include fluorescent markings.

4. A security label as defined in claim 1 further including printed graphics on the top surface of the top layer.

5. A security label as defined in claim 4, wherein the top surface of the top layer is coated with a fluorescent varnish.

6. A security label as defined in claim 4 wherein the printed graphics delineate the edges of the portion of the base layer which is free from the patterned permanent laminating adhesive.

7. A security label as defined in claim 4, wherein the printed graphics include scrambled indicia.

8. A security label as defined in claim 1, wherein the bottom surface of the top layer is coated with a fluorescent varnish.

9. A security label as defined in claim 1, wherein the base layer includes means for reacting to organic solvents by turning an indicator color.

10. A security label as defined in claim 1, wherein the base layer includes means for reacting to base solutions by turning an indicator color.

11. A security label as defined in claim 1, wherein the base layer contains fluorescent fibers.

12. A security label comprising:

safety paper having an upper surface and a lower surface;

a pressure sensitive permanent adhesive layer on the lower surface of the safety paper, the adhesive having adhering power such that attempting to remove the label from a surface it is adhered to will cause the safety paper to tear before the pressure sensitive permanent adhesive will detach;

paper face stock including a top surface and a bottom surface;

a patterned permanent adhesive layer adhering the upper surface of the safety paper to the bottom surface of the paper face stock, said patterned permanent adhesive layer having adhering power such that said safety paper cannot be separated from said paper face stock without destroying either or both, the patterned permanent adhesive layer leaving a portion of the upper surface of the safety paper free from adhesive;

surface graphics applied to the top surface of the paper face stock; and security graphics applied to the bottom surface of the paper face stock.

13. A security label as defined in claim 12, further including release coated backing paper, the safety paper being releasably attached to the release coated backing paper by the pressure sensitive permanent adhesive.

14. A security label as defined in claim 12, wherein the safety paper includes means for reacting to organic solvents by turning an indicator color.

15. A security label as defined in claim 12, wherein the safety paper includes means for reacting to base solutions by turning an indicator color.

16. A security label as defined in claim 12, wherein the safety paper contains fluorescent fibers.

17. A security label as defined in claim 12, wherein the security graphics include fluorescent markings.

18. A security label as defined in claim 12, wherein the bottom surface of the paper face stock is coated with a fluorescent varnish.

19. A security label as defined in claim 12, wherein the top surface of the paper face stock is coated with a fluorescent varnish.

20. A security label comprising:

safety paper having an upper surface and a lower surface;

a pressure sensitive permanent adhesive layer deposited on the lower surface of the safety paper, the adhesive having adhering power such that attempting to remove the label from a surface it is adhered to will cause the safety paper to tear before the pressure sensitive permanent adhesive layer will detach;

a face stock layer including a top surface and a bottom surface;

a patterned adhesive layer securing said safety paper, to said face stock layer, the patterned adhesive layer being formed to leave a portion of the upper surface of the safety paper free from adhesive;

security graphics applied to the bottom surface of the face stock layer, whereby the security graphics may be viewed by slitting the face stock layer and raising it where the face stock layer is not adhered to the safety paper;

surface graphics applied to the top surface of the face stock including optically scrambled indicia; and release coated backing paper, the safety paper being releasable attached to the release coated backing paper by the pressure sensitive permanent adhesive.

* * * * *